US008023685B2

(12) United States Patent
Honda et al.

(10) Patent No.: US 8,023,685 B2
(45) Date of Patent: Sep. 20, 2011

(54) ELECTROACOUSTIC TRANSDUCER AND ELECTRONIC DEVICE USING THE SAME

(75) Inventors: Kazuki Honda, Mie (JP); Takanori Fukuyama, Mie (JP); Koji Sano, Mie (JP); Hiroshi Yano, Mie (JP); Takeshi Shimokawatoko, Mie (JP); Kazuya Yamasaki, Osaka (JP); Kazutaka Kubo, Mie (JP); Masahide Sumiyama, Mie (JP)

(73) Assignee: Panasonic Corporation, Osaka (JP)

( * ) Notice: Subject to any disclaimer, the term of this patent is extended or adjusted under 35 U.S.C. 154(b) by 1102 days.

(21) Appl. No.: 11/570,550

(22) PCT Filed: Jun. 17, 2005

(86) PCT No.: PCT/JP2005/011118

§ 371 (c)(1),
(2), (4) Date: Dec. 13, 2006

(87) PCT Pub. No.: WO2006/001227

PCT Pub. Date: Jan. 5, 2006

(65) Prior Publication Data

US 2007/0269076 A1 Nov. 22, 2007

(30) Foreign Application Priority Data

Jun. 23, 2004 (JP) ..... 2004-184721

(51) Int. Cl.
*H04R 1/02* (2006.01)

(52) U.S. Cl. ..... 381/394; 381/409

(58) Field of Classification Search ..... 381/394, 381/409

See application file for complete search history.

(56) References Cited

U.S. PATENT DOCUMENTS

| | | | | |
|---|---|---|---|---|
| 5,033,093 | A * | 7/1991 | Tardo | 381/177 |
| 6,220,892 | B1 * | 4/2001 | Bishop | 439/500 |
| 6,476,710 | B2 * | 11/2002 | Togawa et al. | 340/384.1 |
| 6,553,126 | B2 * | 4/2003 | Han et al. | 381/409 |
| 6,577,743 | B2 * | 6/2003 | Masuda et al. | 381/409 |
| 6,674,872 | B2 * | 1/2004 | Fujinami et al. | 381/409 |
| 6,748,091 | B2 * | 6/2004 | Hohjyo et al. | 381/174 |
| 6,807,282 | B2 * | 10/2004 | Kaneda et al. | 381/396 |

(Continued)

FOREIGN PATENT DOCUMENTS

EP 1 150 546 A2 10/2001

(Continued)

OTHER PUBLICATIONS

Supplementary European Search Report for Application No. EP 05 75 1515, Dec. 22, 2008, Panasonic Corporation.

(Continued)

*Primary Examiner* — Curtis Kuntz
*Assistant Examiner* — Ryan Robinson
(74) *Attorney, Agent, or Firm* — RatnerPrestia

(57) ABSTRACT

An electroacoustic transducer has a magnetic circuit, a frame combined with the magnetic circuit, a diaphragm combined with a periphery of the frame, a voice coil, a terminal, and a holder covering the frame. The voice coil is combined with the diaphragm and a part of the voice coil is arranged in a magnetic gap of the magnetic circuit. The terminal, made of a metal plate having spring property and electric conductivity, electrically connects an outside circuit and the voice coil utilizing spring pressure generated when the metal plate is bent. The holder forms a stopper for restricting a bend of the metal plate forming the terminal to within a reversible limit of a metallic material.

22 Claims, 7 Drawing Sheets

U.S. PATENT DOCUMENTS

| | | | | |
|---|---|---|---|---|
| 2002/0176352 | A1 | 11/2002 | Konno et al. | |
| 2004/0253867 | A1 * | 12/2004 | Matsumoto | 439/500 |

FOREIGN PATENT DOCUMENTS

| | | | |
|---|---|---|---|
| JP | 07-007777 | A | 1/1995 |
| JP | 2607297 | U | 3/2001 |
| JP | 2003-037890 | A | 2/2003 |
| WO | WO 95/27323 | | 10/1995 |
| WO | WO 98/38834 | | 9/1998 |
| WO | WO 02/34005 | A2 | 4/2002 |

OTHER PUBLICATIONS

International Search Report for Application PCT/JP2005/11118, dated Oct. 4, 2005.

* cited by examiner

ELECTROACOUSTIC TRANSDUCER AND ELECTRONIC DEVICE USING THE SAME

This application is a U.S. National Phase Application of Pct international application PCT/JP2005/011118.

TECHNICAL FIELD

The present invention relates to an electroacoustic transducer used for various types of audio devices and information-communication devices, and to electronic devices such as mobile phones and game machines.

BACKGROUND ART

FIG. 9 is a sectional view of a conventional electroacoustic transducer, which is used for a speaker or a receiver loaded on an electronic device such as a mobile phone. Magnet 101 is sandwiched with top plate 102 and yoke 103, forming internal magnet type magnetic circuit 104. Yoke 103 is press-fitted into frame 106 made of resin and combined with frame 106 by bonding. Diaphragm 107 is bonded to a periphery of frame 106. Voice coil 108 for driving diaphragm 107 is combined with diaphragm 107 and a part of voice coil 108 fits into magnetic gap 105 of magnetic circuit 104.

The lead wire (not illustrated) of voice coil 108 is combined with one end of terminal 110 by soldering. Frame 106 holds a part of terminal 110 by molding. Terminal 110 is bent at central part 110A so as not to extend outward off the outside dimensions of frame 106. Terminal 110, formed by bending a single sheet-like metal plate, contacts a feeding portion (not illustrated) of the electronic device at movable end 110B utilizing the spring pressure of this metal plate. Stopper 109, provided by extending the bottom end of frame 106, is shaped integrally with frame 106 when injection molding frame 106 made of resin.

Stopper 109 restricts the range in which terminal 110 is bent so that a bend of the metal plate forming terminal 110 does not exceed the reversible limit as an elastic body. This prevents terminal 110 from being bent beyond the reversible limit even if speaker 111 is strongly pressed when mounted to the electronic device. Consequently, the inconvenience is resolved in that terminal 110 breaks when mounting speaker 111 and an insufficient spring pressure of terminal 110 causes unstable contact with the device. Speaker 111 is disclosed in Japanese Patent Unexamined Publication No. 2003-37890, for example.

However, accidentally dropping the electronic device with speaker 111 incorporated thereinto can destroy stopper 109 due to an excessive impact force. If stopper 109 is thus destroyed, the spring pressure of the metal terminal of terminal 110 exceeds the reversible limit, causing the contact with the feeding unit at the electronic device to be unstable. Consequently, a contact failure occurs when the electronic device undergoes an impact or vibration, thus resulting in interrupted signals.

SUMMARY OF THE INVENTION

An electroacoustic transducer according to the present invention has a magnetic circuit, a frame combined with the magnetic circuit, a diaphragm combined with a periphery of the frame, a voice coil, a terminal, and a holder covering the frame. The voice coil is combined with the diaphragm and a part of the voice coil is arranged in the magnetic gap of the magnetic circuit. The terminal, made of a metal plate having spring property and electrical conductivity, electrically connects an outside circuit with the voice coil utilizing the spring pressure generated when the metal plate is bent. The holder forms a stopper for restricting a bend of the metal plate forming the terminal so that the bend is within the reversible limit of the metallic material. With this makeup, the terminal does not deform or collapse even if the speaker is mounted to an electronic device with deeply being pressed down or the stopper undergoes an excessive impact force due to the electronic device such as a mobile phone accidentally being dropped. The present invention relates to such an electroacoustic transducer and to an electronic device having an electronic circuit for feeding the electroacoustic transducer.

REFERENCE MARKS IN THE DRAWINGS

Figure 1:
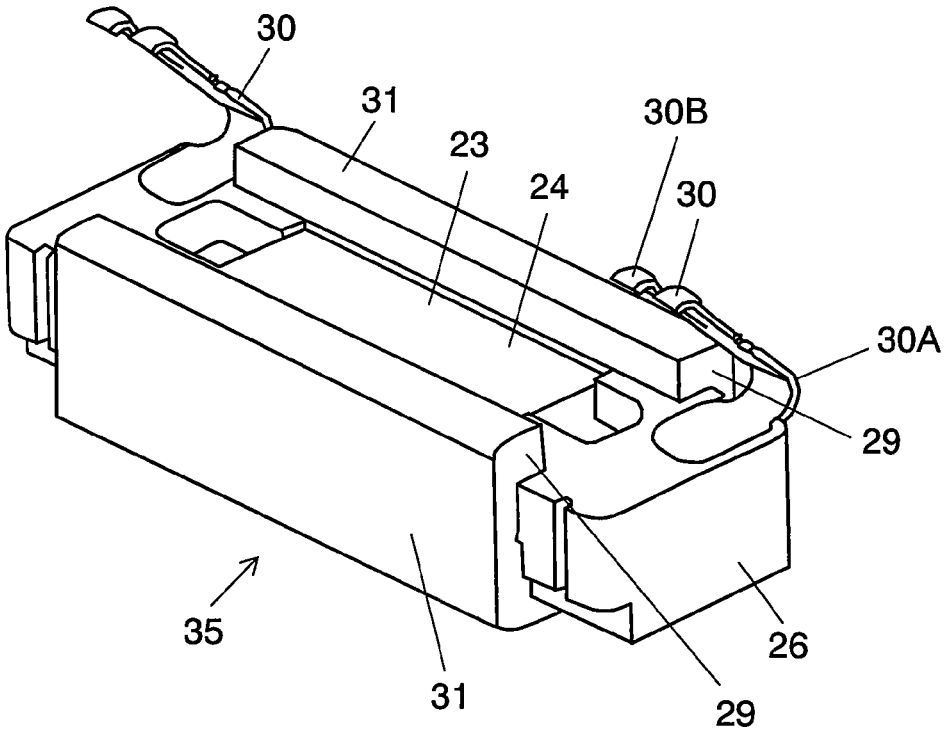
FIG. 1 is a perspective view of a speaker according to the first exemplary embodiment of the present invention.

21 Magnet
22 Top plate
23 Yoke
24 Magnetic circuit
24A Back surface
25 Magnetic gap
26 Frame
26A Back surface
27 Diaphragm
28 Voice coil
29, 29A, 29B Stopper
30 Terminal
30A Central part
30B Movable end
31, 31A, 31B Holder
32 Speaker cover
32A Front surface
35, 35A, 35B Speaker
40 Electronic circuit
60 Display module
70 Outer case
80 Mobile phone
101 Magnet
102 Top plate
103 Yoke
104 Magnetic circuit
105 Magnetic gap
106 Frame
107 Diaphragm
108 Voice coil
109 Stopper
110 Terminal

110A Central part
110B Movable end
111 Speaker

DETAILED DESCRIPTION OF PREFERRED EMBODIMENTS

Hereinafter, a description is made for embodiments of the present invention with reference to related drawings.

First Exemplary Embodiment

Figure 2:
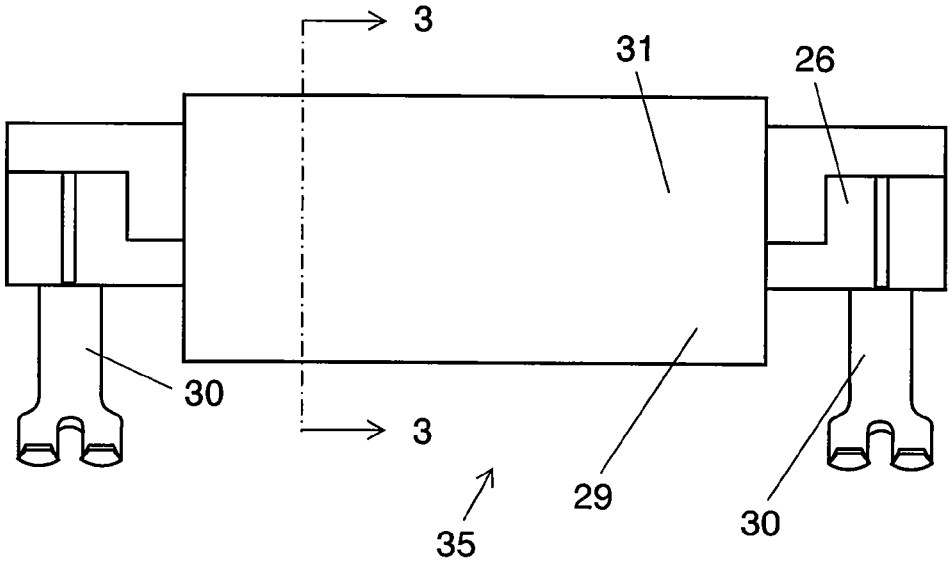
FIG. 2 is a front view of the speaker shown in FIG. 1.
Figure 3:
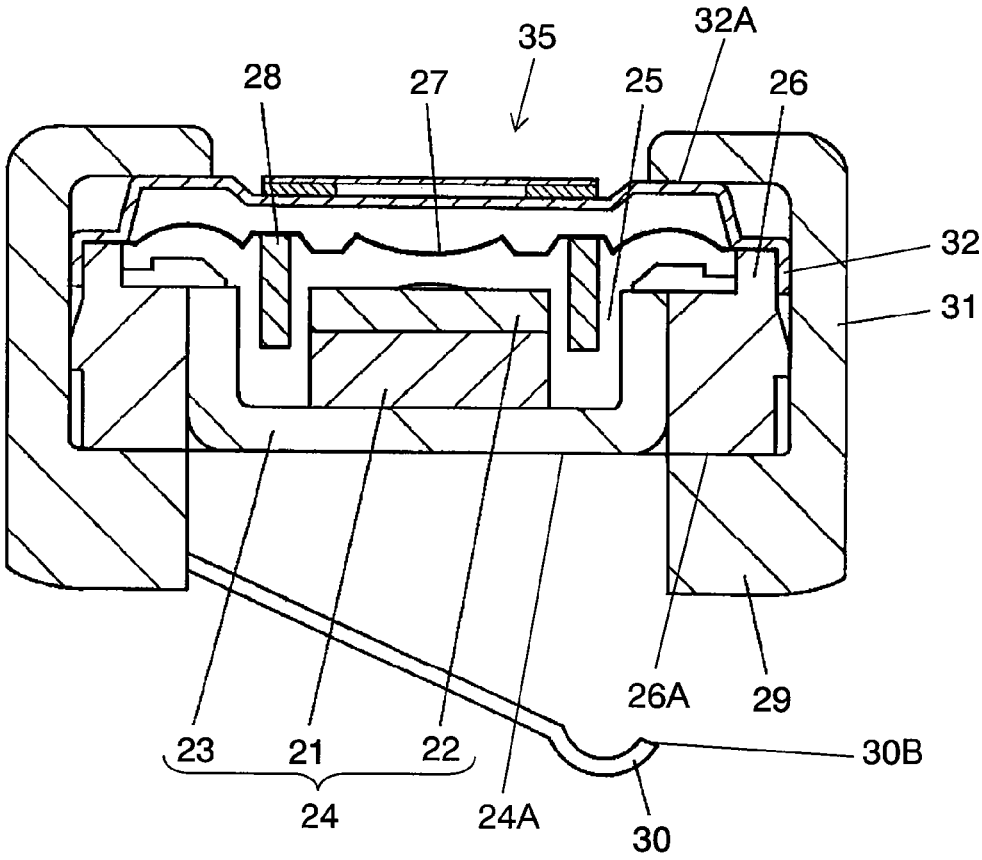
FIG. 3 is a sectional view of the speaker shown in FIG. 2, taken along line 3-3.
Figure 4:
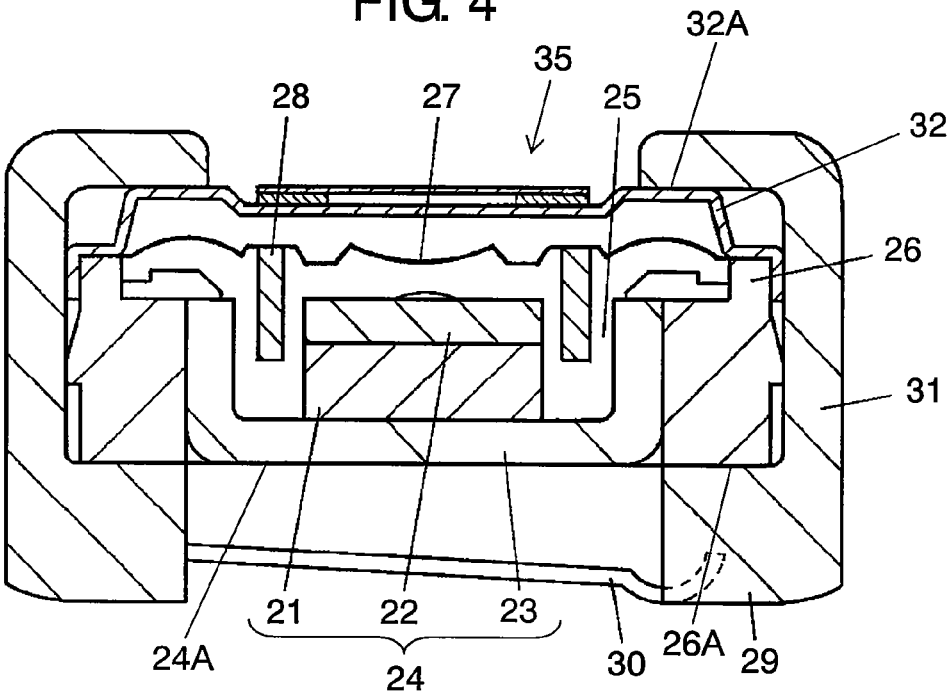
FIG. 4 is a sectional view of the speaker shown in FIG. 3, with its terminal bent.

FIG. 1 is a perspective view illustrating a speaker as an electroacoustic transducer according to the first exemplary embodiment of the present invention. FIG. 2 is the front view of the speaker shown in FIG. 1. FIG. 3 is a sectional view of the speaker shown in FIG. 2, taken along line 3-3. FIG. 4 is a sectional view of the speaker shown in FIG. 3, illustrating a state of a terminal when the terminal reached the bottom dead center owing to protection by a stopper. In this embodiment, an example where the present invention is applied to a slim speaker with its outside shape rectangular is described, but not limited.

As shown in FIGS. 1 through 4, magnetized magnet 21, sandwiched with top plate 22 and yoke 23, forms internal magnet type magnetic circuit 24. Yoke 23, composing a part of magnetic circuit 24, is press-fitted into frame 26 made of resin. Frame 26 holds a part of terminal 30 by molding. Magnetic circuit 24 is combined with frame 26 by bonding.

Diaphragm 27 is bonded to a periphery of frame 26. Speaker cover 32 protects diaphragm 27. Frame 26 and speaker cover 32 compose a frame forming speaker 35, where speaker cover 32 is not necessarily required. Voice coil 28 for driving diaphragm 27 is combined with diaphragm 27. A part of voice coil 28 is arranged to fit into magnetic gap 25 formed in magnetic circuit 24. Voice coil 28 is electrically connected to one end of terminal 30 with a lead wire (not illustrated) by soldering. Terminal 30 is bent at central part 30A so as not to extend outward off the outside dimensions of frame 26. Further, movable end 30B of terminal 30 is formed as a feed terminal to be connected to an outside circuit at an electronic device. Speaker 35 is inserted into holder 31 made of an elastic body.

Holder 31 is shaped so as to cover the entire speaker 35. Front surface 32A of speaker cover 32 and back surface 26A of frame 26 are partially covered with holder 31 respectively.

Holder 31 has functions such as for preventing a rattle noise and an air leak occurring between the electronic device and frame 26, for waterproofing, and for protecting speaker 35 against an external impact, when speaker 35 is mounted to the electronic device such as a mobile phone.

Moreover, at back surface 26A side holder 31 functions as stopper 29 for restricting the range in which terminal 30 is bent. The material thickness of holder 31 at back surface 26A side is adjusted so that the spring pressure of the metallic material forming terminal 30 is restricted to within the reversible limit of the elastic body.

Holder 31, made of an elastic body having high impact resistance and restorative capacity, functions as stopper 29 by means of the material thickness being adjusted. Therefore, stopper 29 has strong restorative capacity and high impact resistance. With these characteristics, terminal 30 does not present plastic deformation, and the spring pressure of terminal 30 is maintained without a decrease.

Holder 31 thus functions for protecting both speaker 35 and terminal 30 Holder 31 has those actions and effects, also. So, holder 31 is highly valuable. Further, the double functions of holder 31 reduce the number of components, and thus the cost of speaker 35.

In the first exemplary embodiment, the description is made for internal magnet type magnetic circuit 24, but not limited. The present invention may be applied to an electroacoustic transducer having an external magnet type magnetic circuit.

Preferably, holder 31 is made of a polymeric material. A polymeric material such as rubber, sponge, and foamed material can be used. A polymeric material generally has high shock-absorbing ability and restorative capacity. Holder 31, with these properties, absorbs an excessive force due to a drop impact or the like, to protect speaker 35 and to endure a large number of drop impacts or the like.

With this makeup, terminal 30 is bent to some extent when speaker 35 is mounted to the electronic device, resulting in terminal 30 connected with an appropriate spring pressure applied to the feeding unit of the outside circuit at the electronic device. Even if speaker 35 is mounted while being strongly pressed, stopper 29 touches the outside circuit to prevent terminal 30 from further deforming.

Meanwhile, even if the electronic device such as a mobile phone is accidentally dropped to apply an excessive impact force to terminal 30, the impact-absorbing effect of stopper 29 suppresses deformation exceeding the reversible limit of the metallic material forming terminal 30. Consequently, deformation of the metallic material forming terminal 30 is restricted to within the reversible limit as an elastic body, terminal 30 does not present plastic deformation, and the spring pressure is maintained without a decrease. As a result, a strong spring pressure of terminal 30 is maintained over a long period, stabilizing the connection with the feeding unit. Therefore, a connection failure does not occur when the electronic device undergoes an impact or vibration, thus resulting in uninterrupted, stable signals.

Furthermore, it is preferable that holder 31 is made of silicon rubber. Silicon rubber has high shock-absorbing ability and restorative capacity. Consequently, silicon rubber, like the above-mentioned polymeric material, absorbs an excessive force due to a drop impact or the like, to protect the speaker and to endure a large number of drop impacts or the like. Additionally, silicon rubber is excellent in environmental tolerance such as thermal shock resistance and chemical resistance, thus maintaining characteristics such as shock-absorbing ability and restorative capacity over a long period.

In addition, it is preferable that the hardness of silicon rubber used for holder 31 have a rubber hardness of 20 degrees or higher in Shore A hardness (defined by JIS K 6253A), more preferably 30 degrees to 60 degrees. By using silicon rubber with such rubber hardness, deformation due to an excessive drop impact force is further suppressed, and the spring pressure of the metallic material forming terminal 30 is effectively restricted to within the reversible limit, to reliably protect terminal 30. Further, the higher performance to absorb an excessive drop impact force effectively protects speaker 35, thus improving the reliability of the electronic device.

As a result that holder 31 doubles as stopper 29, the area of the back surface of stopper 29 for catching an impact force and a force when mounting can be set to a large area. Preferably, the area is 10% or more of the area of the back surface of speaker 35, more preferably 30% or more, and further preferably 50% or more, to further improve the impact-absorbing effect of holder 31. Consequently, both functions for protecting terminal 30 and speaker 35 are maintained over a long period without buckling even if relatively soft silicon rubber is used for holder 31.

Second Exemplary Embodiment

Figure 5:
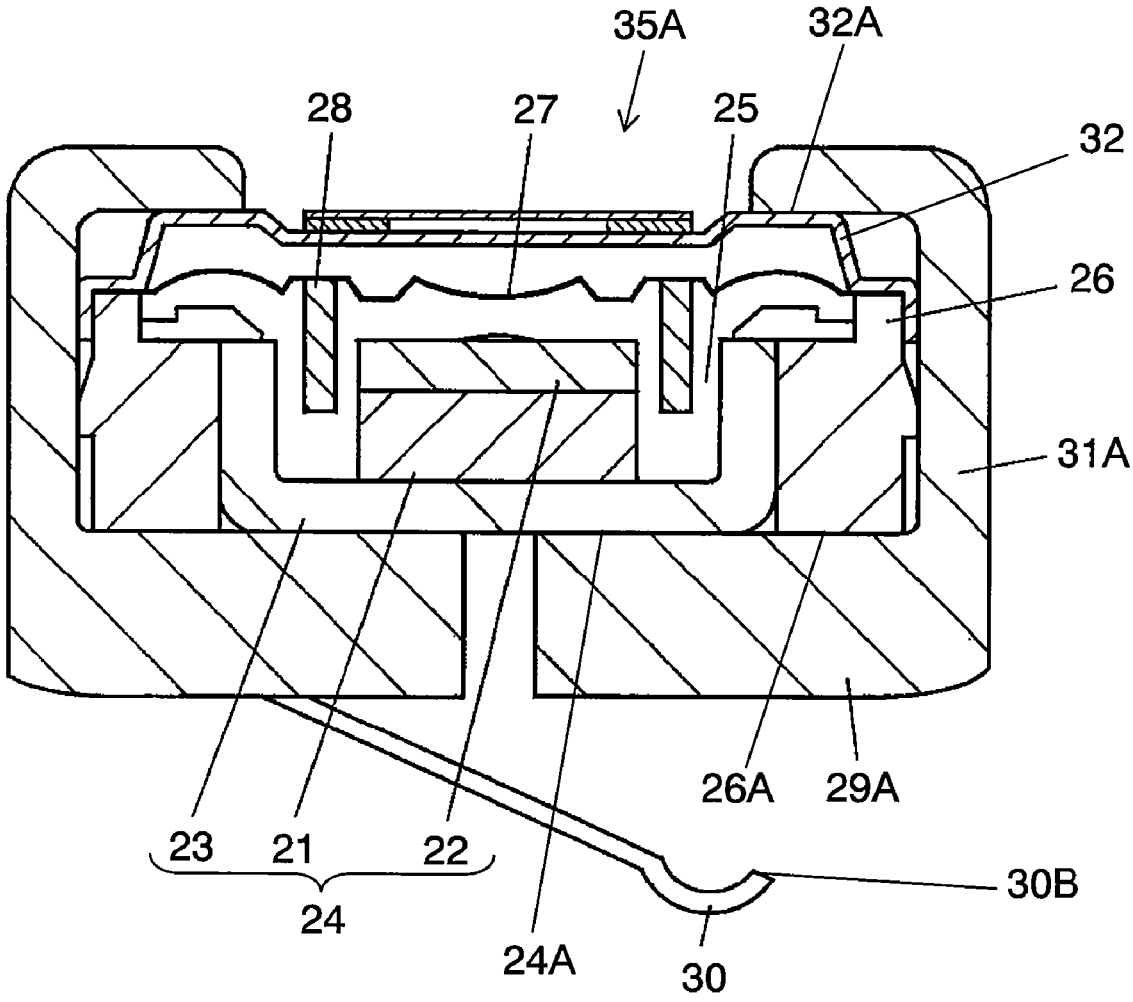
FIG. 5 is a sectional view of a speaker according to the second exemplary embodiment of the present invention.
Figure 6:
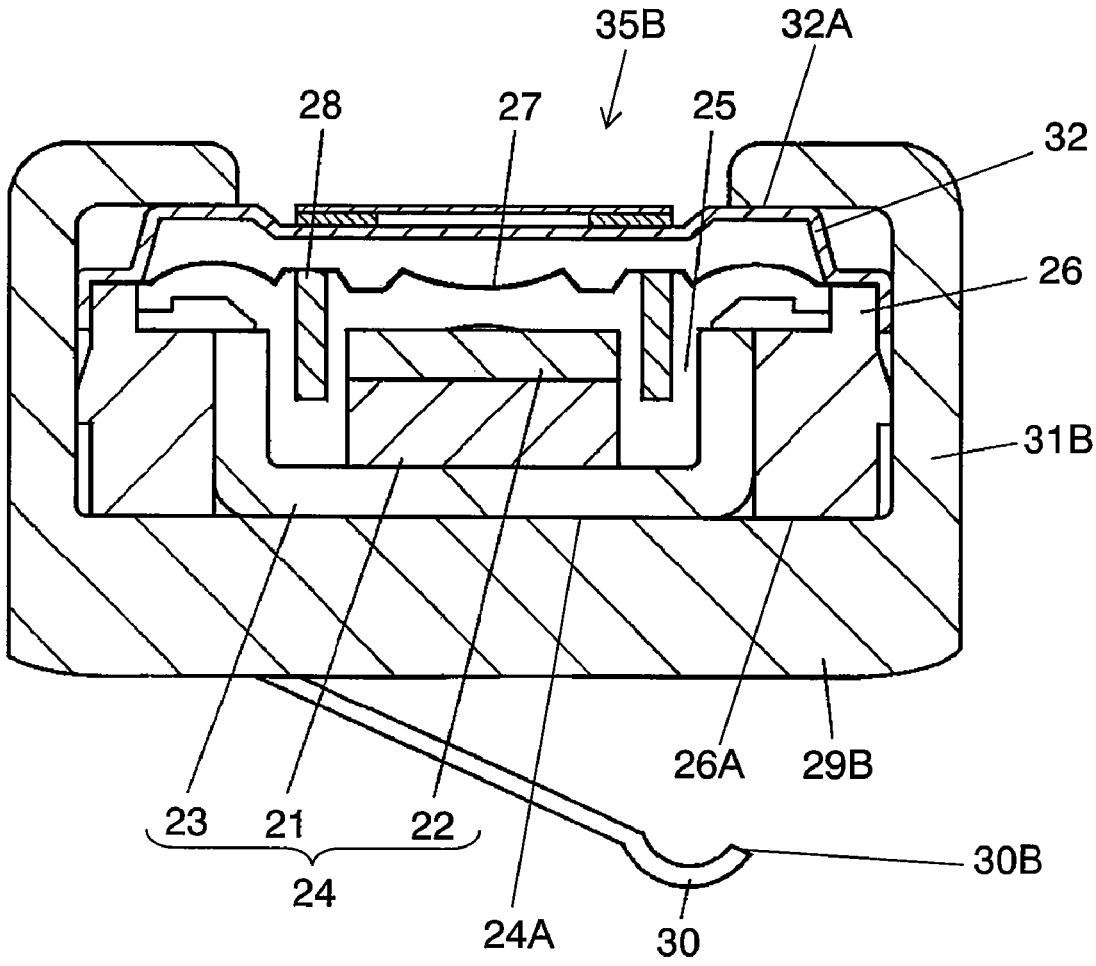
FIG. 6 is a sectional view of the speaker according to the second exemplary embodiment of the present invention.

Hereinafter, a description is made for the second exemplary embodiment using FIGS. 5 and 6. FIGS. 5 and 6 are respectively sectional views illustrating a speaker according to the second exemplary embodiment of the present invention. A constructional element same as that in the first exemplary embodiment is given the same mark to omit its detailed description. From then on, only the differences from the first exemplary embodiment are described.

As shown in FIG. 5, holder 31A is formed with being extended to back surface 24A of magnetic circuit 24, where back surface 24A is also the back surface of yoke 23.

Still as shown in FIG. 6, holder 31B is formed so that it covers back surface 24A of magnetic circuit 24 and the cross section of holder 31 is C-shaped.

With this makeup, an impact force undergone by stoppers 29A and 29B formed at a part of holders 31A and 31B is caught by magnetic circuit 24 made of a hard metallic body. This makeup further improves the impact resistance of speakers 35A and 35B, thus further improving the reliability of the electronic device such as a mobile phone.

In addition, as shown in FIG. 6, as a result that holder 31B is formed to be C-shaped, holder 31B is resistant to dropping out of speaker 35B, further improving the reliability in absorbing an impact force.

Here, this makeup is feasible with a lower plate included in an external magnet type magnetic circuit, as well as with an internal magnet type electroacoustic transducer, which corresponds to the above-mentioned speakers 35A and 35B.

Third Exemplary Embodiment

Figure 7:
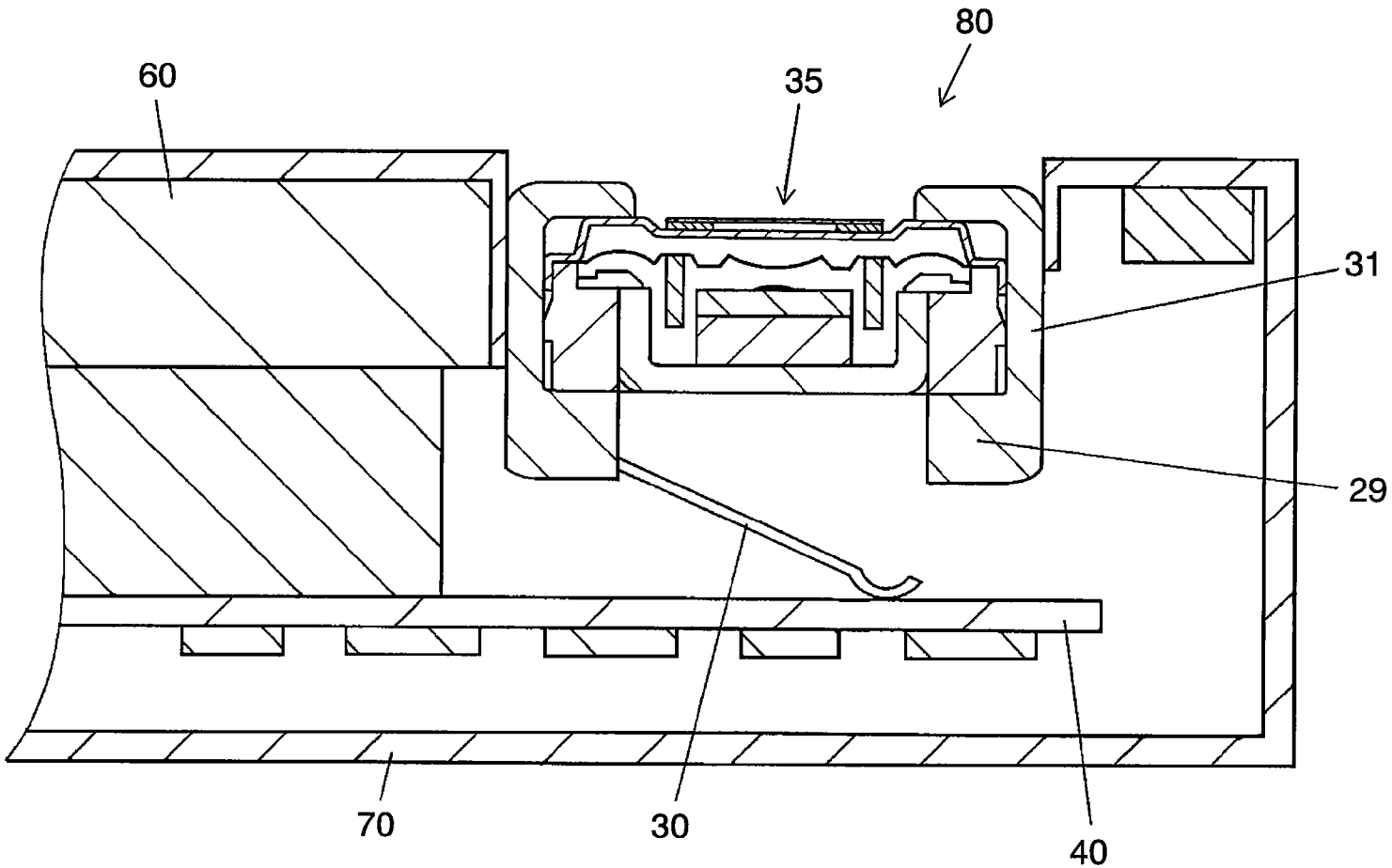
FIG. 7 is a sectional view of the substantial part of an electronic device according to the third exemplary embodiment of the present invention.
Figure 8:
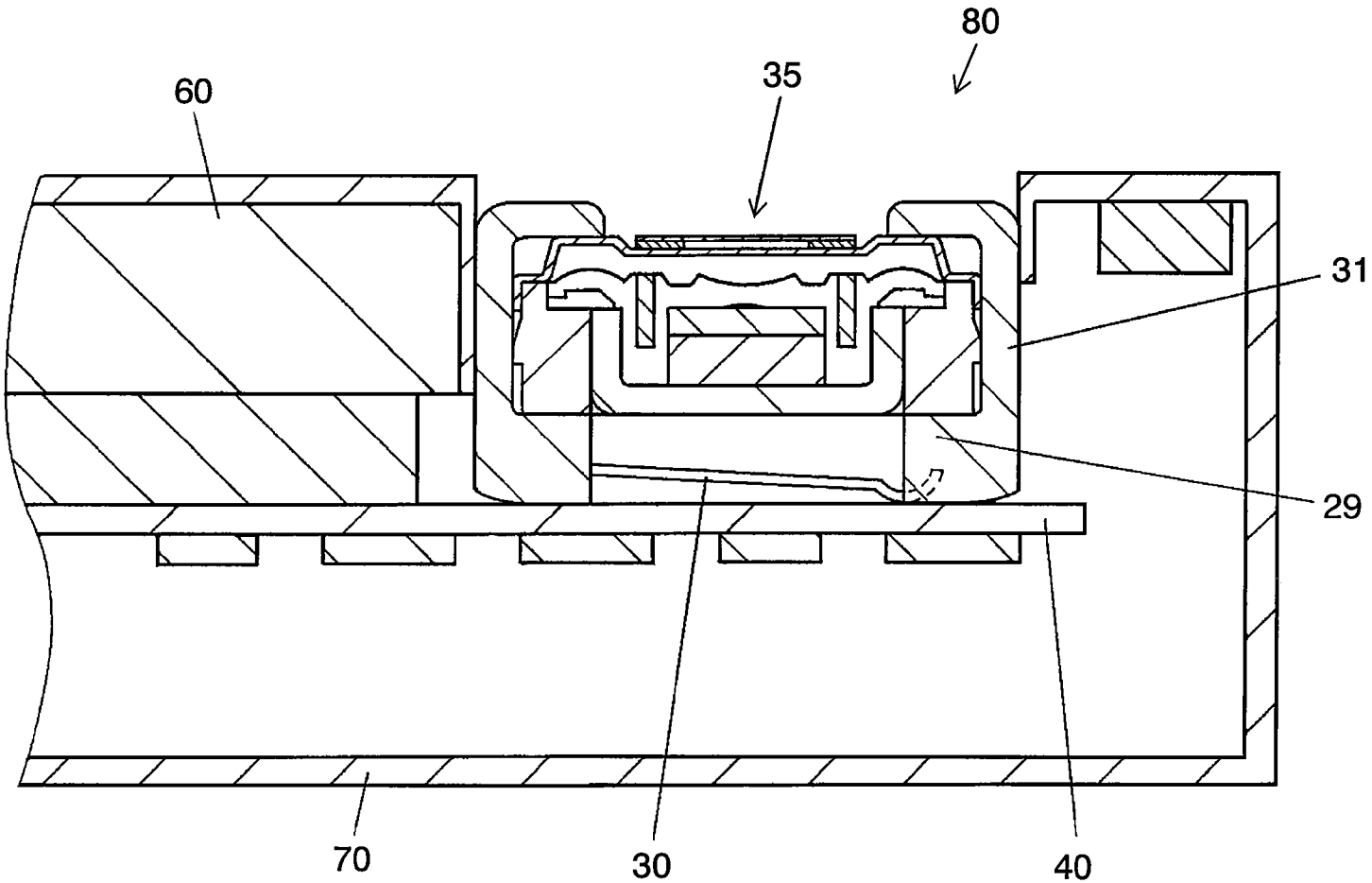
FIG. 8 is a sectional view of the substantial part of the electronic device shown in FIG. 7, when an impact is applied.
Figure 9:
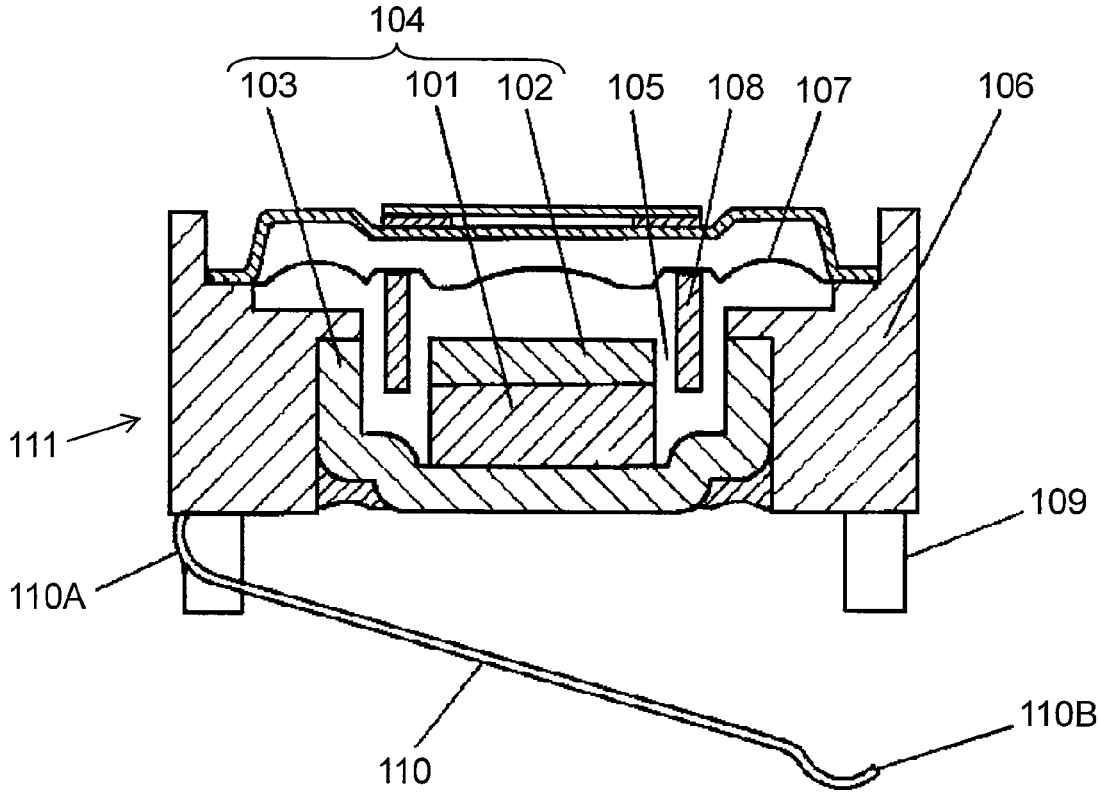
FIG. 9 PRIOR ART
FIG. 9 is a sectional view of a conventional speaker.

Hereinafter, a description is made for the third exemplary embodiment using FIGS. 7 and 8. FIGS. 7 and 8 are sectional views of the substantial part of a mobile phone as an electronic device according to the third exemplary embodiment of the present invention.

As shown in FIGS. 7 and 8, mobile phone 80 is composed of components and modules such as speaker 35; electronic circuit 40 as an outside circuit; display module 60 such as a liquid crystal panel, those loaded inside outer case 70. For speaker 35 loaded inside outer case 70, speakers 35, 35A, 35B described in the above first and second exemplary embodiments can be used. Spring pressure applied to terminal 30 and electronic circuit 40 causes them to electrically contact each other, thus feeding speaker 35 to operate.

With this makeup, terminal 30 does not present permanent plastic deformation even if speaker 35 is mounted to mobile phone 80 with deeply being pressed down. Still, the impact resistance and elastic property of stopper 29 prevent permanent deformation and destruction of terminal 30 even if an excessive impact force is applied to terminal 30 and stopper 29 due to mobile phone 80 accidentally having been dropped. That is, the spring pressure of the metallic material forming terminal 30 is restricted to within its reversible limit, terminal 30 does not present plastic deformation, and the spring pressure of terminal 30 is maintained without a decrease.

Consequently, terminal 30 maintains its strong spring pressure over a long period. Connection with the feeding unit of electronic circuit 40 is stabilized, and a contact failure does not occur even if mobile phone 80 is applied with an impact or vibration, thus resulting in uninterrupted, stable signals. This improves the reliability and quality of the electronic device such as a mobile phone.

Here, the description is made for mobile phone 80 as an example of an electronic device, but not limited. The present invention can be applied to an electronic device as long as it is loaded with an electroacoustic transducer, such as audiovisuals including a DVD player and CD player; information-communication devices including a personal computer and PDA; and game machines.

INDUSTRIAL APPLICABILITY

An electroacoustic transducer and an electronic device according to the present invention are applied to electronic devices that require improving reliability and quality, such as audiovisuals, information-communication devices, and game machines.

The invention claimed is:

1. An electroacoustic transducer, comprising:
- a magnetic circuit;
- a frame combined with the magnetic circuit;
- a diaphragm combined with a periphery of the frame;
- a voice coil combined with the diaphragm and partially arranged in a magnetic gap of the magnetic circuit;
- at least two terminals, each terminal made of a metal plate having a spring property and an electrical conductivity, and electrically connecting an outside circuit and the voice coil utilizing a spring pressure generated when the metal plate is bent; and
- a holder made of an elastic body, the holder extending from a front surface to a back surface via opposing side surfaces of the frame to cover the frame, wherein the holder extends between the at least two terminals on the frame and the holder forms a stopper for restricting a bend of the metal plate forming the terminal to within a reversible limit of the metal.

2. The electroacoustic transducer of claim 1, wherein the stopper is provided at a back surface of the magnetic circuit.

3. The electroacoustic transducer of claim 1, wherein the holder is made of a polymeric material.

4. The electroacoustic transducer of claim 3, wherein the holder is made of silicon rubber.

5. The electroacoustic transducer of claim 4, wherein the holder is made of silicon rubber of a rubber hardness of 20 degrees or higher.

6. An electronic device, comprising:
- an electroacoustic transducer including:
- a magnetic circuit;
- a frame combined with the magnetic circuit;
- a diaphragm combined with a periphery of the frame;
- a voice coil combined with the diaphragm and partially arranged in a magnetic gap of the magnetic circuit;
- at least two terminals, each terminal made of a metal plate having a spring property and an electrical conductivity, and electrically connecting an outside circuit and the voice coil utilizing a spring pressure generated when the metal plate is bent; and
- a holder made of an elastic body, the holder extending from a front surface to a back surface via opposing side surfaces of the frame to cover the frame, wherein the holder extends between the at least two terminals on the frame and the holder forms a stopper for restricting a bend of the metal plate forming the terminal to within a reversible limit of the metal; and
- an electronic circuit electrically connected with the electroacoustic transducer through the terminal, and feeding the electroacoustic transducer.

7. The electronic device of claim 6, wherein the stopper is provided at a back surface of the magnetic circuit.

8. The electronic device of claim 6, wherein the holder is made of a polymeric material.

9. The electronic device of claim 8, wherein the holder is made of silicon rubber.

10. The electronic device of claim 9, wherein the holder is made of silicon rubber of a rubber hardness of 20 degrees or higher.

11. The electroacoustic transducer of claim 2, wherein the holder is made of a polymeric material.

12. The electroacoustic transducer of claim 11, wherein the holder is made of silicon rubber.

13. The electroacoustic transducer of claim 12, wherein the holder is made of silicon rubber of a rubber hardness of 20 degrees or higher.

14. The electronic device of claim 7, wherein the holder is made of a polymeric material.

15. The electronic device of claim 14, wherein the holder is made of silicon rubber.

16. The electronic device of claim 15, wherein the holder is made of silicon rubber of a rubber hardness of 20 degrees or higher.

17. The electroacoustic transducer of claim 1, wherein the holder covers a whole back surface of the magnetic circuit.

18. The electroacoustic transducer of claim 1, wherein the holder includes a first holder portion and a second holder portion each disposed on the back surface of the frame, a fixed end of each terminal adjacent the first holder portion and a movable end of each terminal adjacent the second holder portion.

19. The electronic device of claim 6, wherein the holder covers a whole back surface of the magnetic circuit.

20. The electronic device of claim 6, wherein the holder includes a first holder portion and a second holder portion each disposed on the back surface of the frame, a fixed end of each terminal adjacent the first holder portion and a movable end of each terminal adjacent the second holder portion.

21. The electroacoustic transducer of claim 1, wherein each of the terminals include a fixed end disposed on the back surface of the frame in a region of the back surface excluding the holder.

22. The electronic device of claim 6, wherein each of the terminals include a fixed end disposed on the back surface of the frame in a region of the back surface excluding the holder.

* * * * *